US011071883B2

(12) United States Patent
Poulin-Simard

(10) Patent No.: US 11,071,883 B2
(45) Date of Patent: Jul. 27, 2021

(54) MODE CHANGING MECHANISM FOR USE WITH A POLE

(71) Applicant: Frederic Poulin-Simard, Sainte-Marie (CA)

(72) Inventor: Frederic Poulin-Simard, Sainte-Marie (CA)

( * ) Notice: Subject to any disclaimer, the term of this patent is extended or adjusted under 35 U.S.C. 154(b) by 15 days.

(21) Appl. No.: 16/775,484

(22) Filed: Jan. 29, 2020

(65) Prior Publication Data

US 2020/0238121 A1 Jul. 30, 2020

Related U.S. Application Data

(60) Provisional application No. 62/918,411, filed on Jan. 29, 2019.

(51) Int. Cl.
*A63B 9/00* (2006.01)

(52) U.S. Cl.
CPC ..... *A63B 9/00* (2013.01); *A63B 2244/225* (2013.01)

(58) Field of Classification Search
CPC ... A63B 2244/225; A63B 71/023; A63B 9/00; E04H 12/22; E04H 12/2238; E04H 12/2284; A47G 33/126; A47F 5/02
USPC ..... 248/521, 522, 519, 523, 539, 349.1
See application file for complete search history.

(56) References Cited

U.S. PATENT DOCUMENTS 2,601,088 A * 6/1952 Burgess ..... F16B 9/054 248/539
3,446,523 A 5/1969 Little
4,084,814 A * 4/1978 Boggild ..... A63B 9/00 248/511
4,895,339 A * 1/1990 Yang ..... A47G 33/126 248/522
7,338,411 B2 3/2008 Blacker
2004/0220031 A1* 11/2004 Blacker ..... A63B 21/1681 482/148
2008/0070753 A1 3/2008 Suida et al.
2010/0041519 A1* 2/2010 Law ..... A63B 71/023 482/27
2013/0175422 A1* 7/2013 Clarke ..... E04H 12/2261 248/523
2013/0206954 A1* 8/2013 Wells ..... E04H 12/2269 248/523
2016/0037952 A1* 2/2016 Leung ..... A47G 33/1206 248/523
2018/0169455 A1* 6/2018 Jarosz ..... A63B 21/1681
2019/0257044 A1* 8/2019 Hughes, Jr. ..... E04H 12/2292
2020/0023261 A1* 1/2020 Coote ..... A63B 71/023

* cited by examiner

*Primary Examiner* — Jennifer Robertson
*Assistant Examiner* — Catrina A Letterman

(57) ABSTRACT

It is a main purpose of this invention to provide for a mode changing mechanism for use with a pole. A "J" shaped locking/un-locking mechanism is provided on an outer ring of the invention, which enables a user to select between a fixed and a rotating mode for the pole. A switch positioned in the "J" shaped groove enables the alternation between the fixed configuration and the rotating configuration of the pole. The rotating configuration enables the pole to rotate freely and the fixed configuration does not allow the pole to rotate. The pole is mechanically fastened to an inner ring. The inner ring is configured to rotate around an axis member fastened to a base plate of the mechanism. An outer ring is concentrically positioned outside the inner ring, the outer ring having the "J" shaped groove.

6 Claims, 4 Drawing Sheets

MODE CHANGING MECHANISM FOR USE WITH A POLE

CROSS-REFERENCE TO RELATED APPLICATIONS

The present application claims priority to Provisional Application Ser. No. 62/518,411, filed on Jan. 29, 2019, the disclosure of which is hereby incorporated in its entirety at least by reference.

BACKGROUND OF THE INVENTION

1. Field of the Invention

The present invention relates generally to exercise equipment but more particularly to a mode changing mechanism for use with a pole.

2. Description of Related Art

Following the Demi Moore film entitled "Striptease", there has been a surge in the popularity of brass poles as a form or exercise. This was further popularized by gymnasts using the pole for performing skillful moves for "circus style" performances. Due to the new demands on the poles, some artists have requested a rotating pole to facilitate certain moves. However a rotating pole makes it difficult to do other moves. Ideally, a pole should be able to be in a fixed mode as well as a rotating mode, and be able to easily switch between modes. As of now, short of having a screwdriver or Allen key to reconfigure a pole, there are no practical, "no tools required" way of changing the configuration in seconds. Consequently, there is need for a mode changing mechanism for use with a pole that will allow a user to switch between a fixed and rotating mode.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main purpose of this invention to provide for a mode changing mechanism for use with a pole. In order to do so, the invention is comprised of a base plate; an inner ring, wherein the pole is mechanically fastened to the inner ring, the inner ring configured to rotate around an axis member fastened to the base plate; an outer ring concentrically positioned outside the inner ring, the outer ring having a "J" shaped groove; a switch positioned in the "J" shaped groove, the switch configured to alternate between a fixed configuration and a rotating configuration of the pole, wherein the rotating configuration enables the pole to rotate freely and the fixed configuration does not allow the pole to rotate.

In one embodiment, the outer ring includes bottom extensions extending integrally from a bottom portion of the outer ring. In one embodiment, in the fixed configuration, the bottom extensions are configured to engage into grooves located in the base plate to prevent rotation of the outer ring. In one embodiment, in the fixed configuration, the inner ring is prevented from rotating as the switch positioned inside the "J" shaped groove is connected to a side of the inner ring. In another embodiment, in the rotating configuration, the outer ring is raised above the base plate such that the bottom extension are not engaged into the grooves enabling the outer ring, inner ring, and the pole to rotate freely. In yet another embodiment, the base plate includes a rubber pad configured to rest on a floor surface.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to provide a mode changing mechanism for use with a pole.

Figure 1:
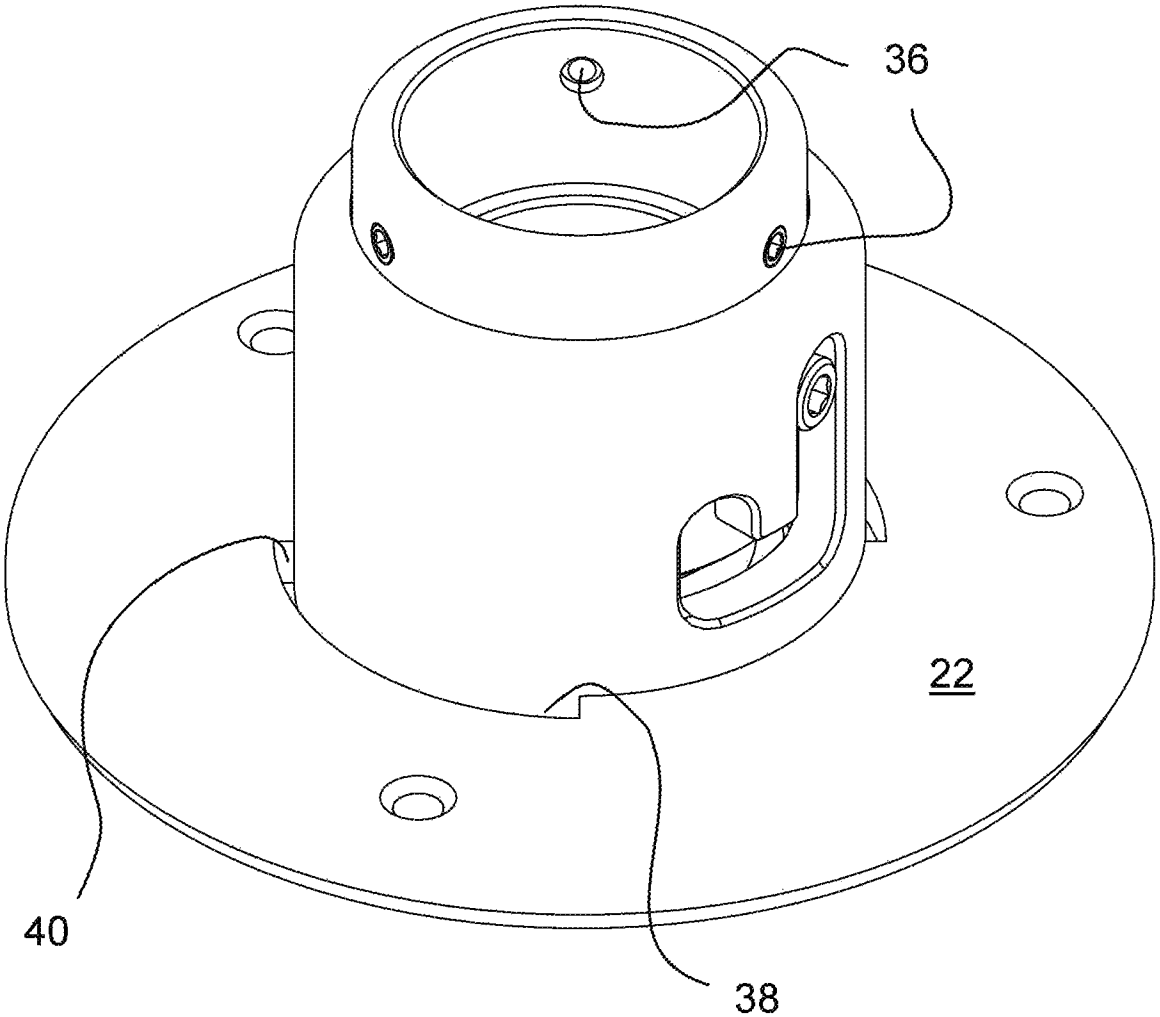
FIG. 1 is an isometric view of a mode changing mechanism for use with a pole according to an embodiment of the present invention.
Figure 2B:
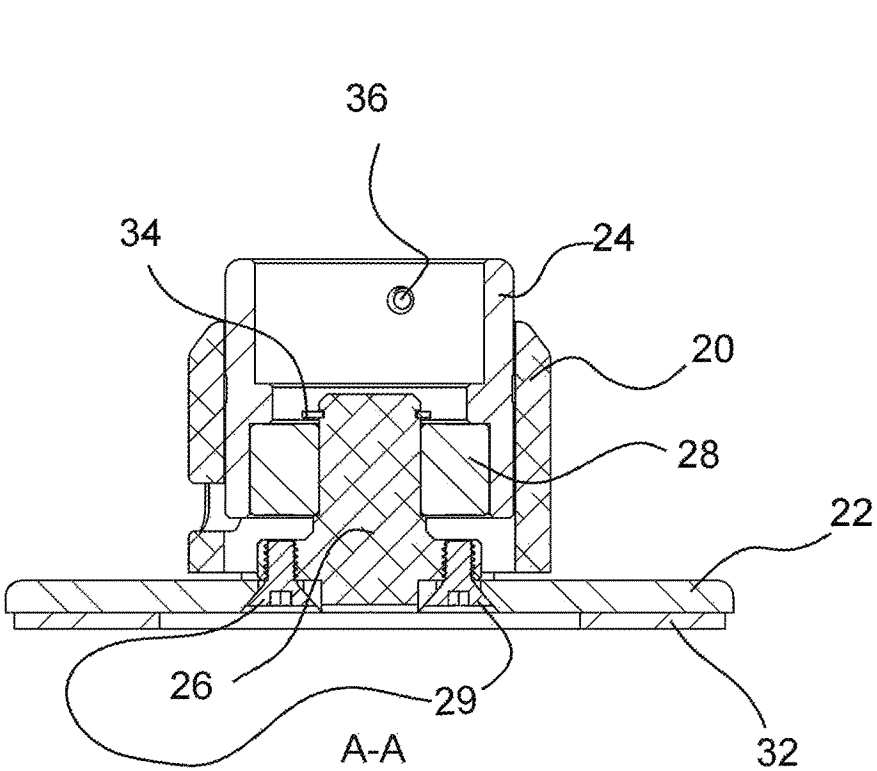
FIGS. 2A-B are side and cutaway views of the mode changing mechanism along A-A respectively according to an embodiment of the present invention.
Figure 2A:
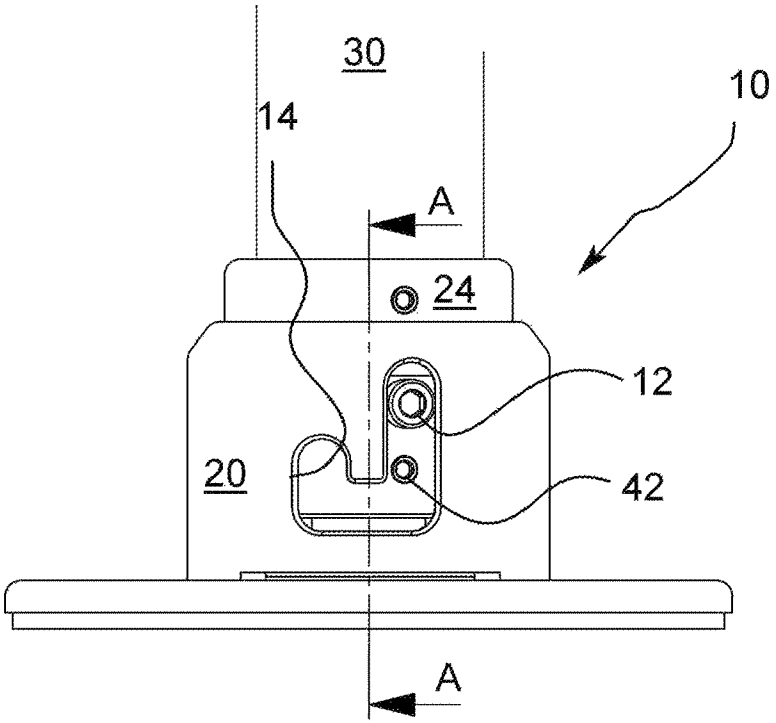
Figure 3B:
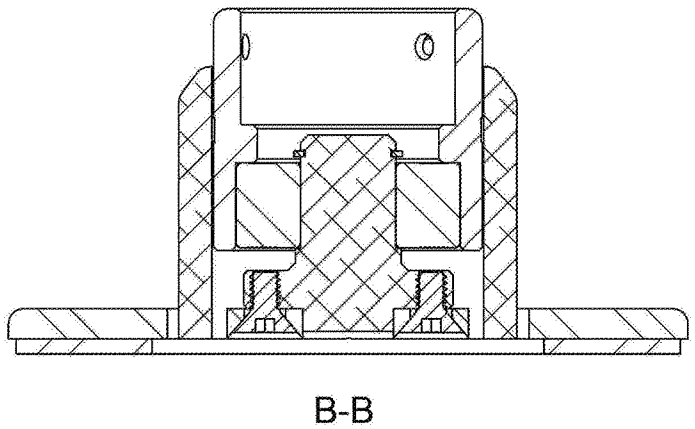
FIGS. 3A-D show a side view and a related cutaway view along B-B followed by a side view and a related view along A-A with outer ring engaged in base plate of the mode changing mechanism according an embodiment of the present invention.
Figure 3D:
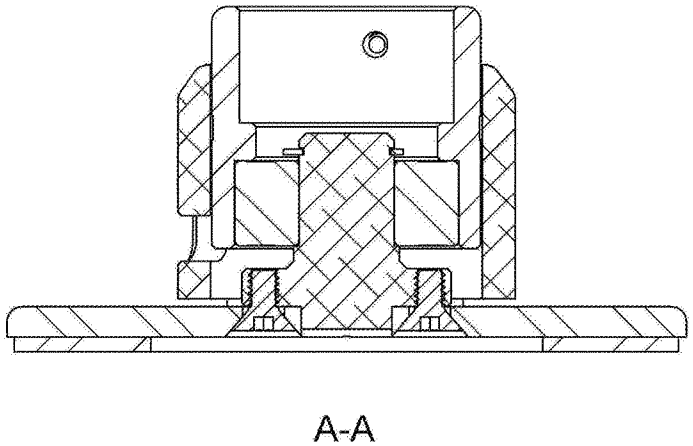
Figure 3A:
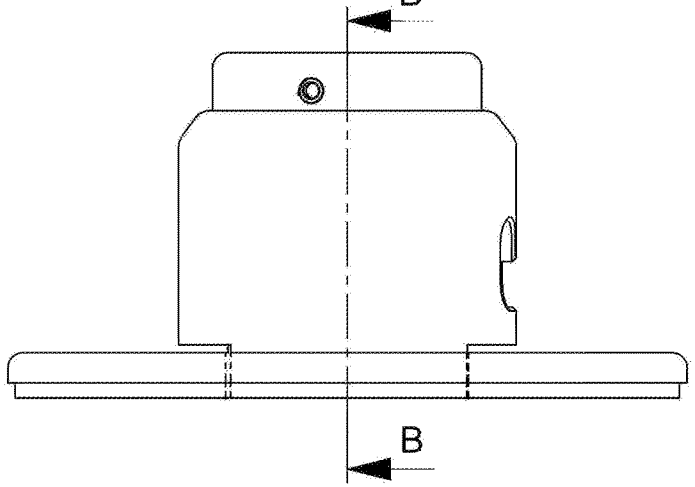
Figure 3C:
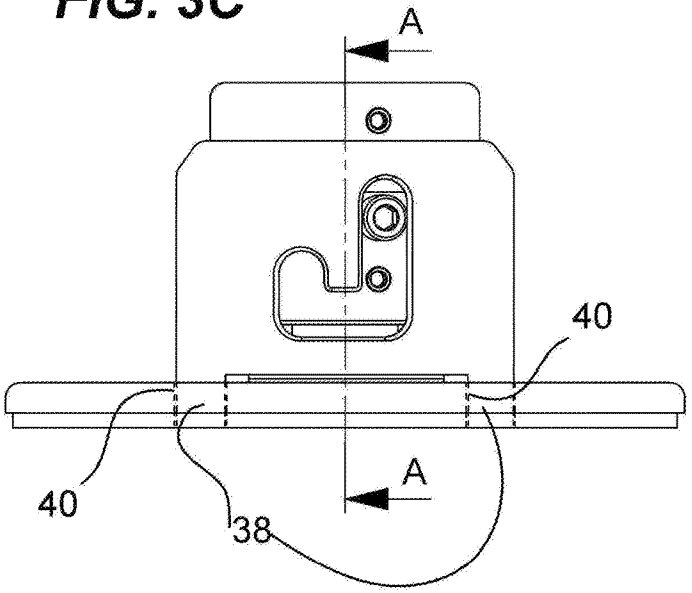
Figure 4B:
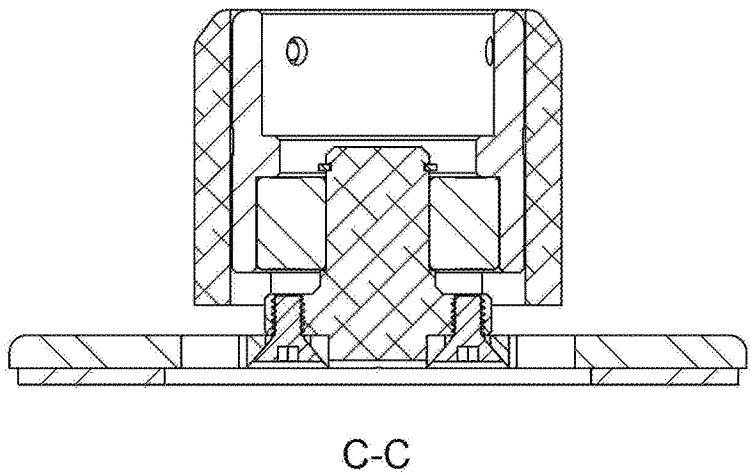
FIGS. 4A-D show a side view and a related cutaway view along C-C followed by a side view and a related view along C-C when the outer ring is pivoted so as to raise above the base plate to provide rotation to the pole according to an embodiment of the present invention.
Figure 4D:
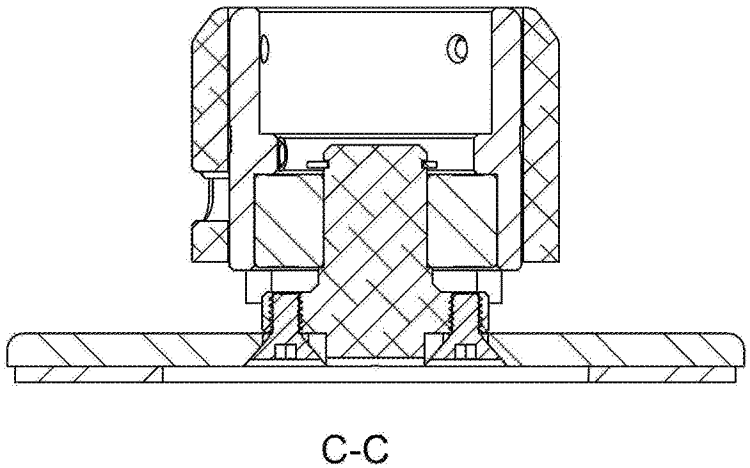
Figure 4A:
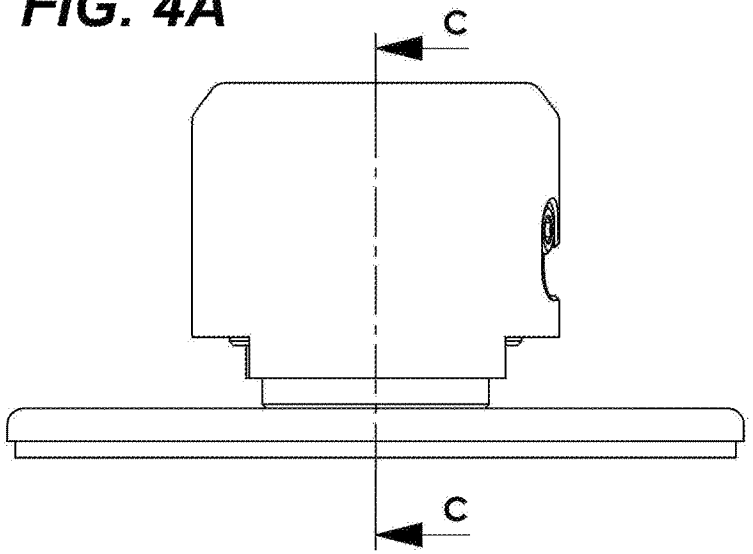
Figure 4C:
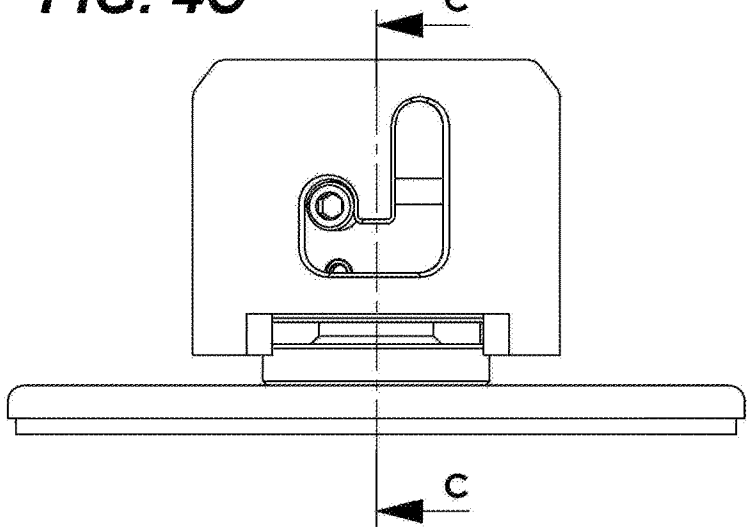

Referring now to FIGS. 1, 2A, and 2B, a mode changing mechanism 10 for use with a pole 30 is illustrated. Advantageously, the mode changing mechanism 10 comprises a switch 12 located in a "J" shaped groove 14, wherein the switch 12 is configured to alternate between a fixed configuration and a rotating configuration of the pole 30. In one embodiment, the alternation between the fixed configuration and the rotating configuration of the pole is done when the switch 12 moves inside the "J" shaped groove 14 made from a groove cut into the face of an outer ring 20. The mode changing mechanism further comprises an inner ring 24 positioned inside the outer ring 20, wherein the pole 30 is configured to be fixed to the inner ring 24. In one embodiment, the pole 30 is mechanically fastened inside the inner ring 24 by way of mechanical fasteners threaded into threaded holes 36.

In one embodiment, the mode changing mechanism comprises a combination of a base plate 22 and a rubber pad 32 configured to rest on the floor in a frictional engagement. In alternative embodiments, the mode changing mechanism may be mechanically fastened to the floor. It should be noted that the pole 30 extends all the way up to the ceiling where it is contained in a top mount (not shown) which has a rotating ball bearing enabling rotation of the pole. Since the top mount is similar in nature to what is available in the prior art, it needs not be further discussed herein. The prior art has both top and bottom mounts being identical in nature and therefore only operate in rotating mode since they lack any means to stop the rotation. The pole 30 is also well known in the art and is cut to length so that it can be mounted in such a way as to tightly fit between floor and ceiling. Alternatively, the pole may be mounted between one or two solid brackets acting the same as a floor to ceiling connection.

Referring now to FIGS. 3A-D, the switch 12 is positioned such that the outer ring 20 is in a non-rotating configuration. Alternatively, referring now to FIGS. 4A-D, the switch 12 is positioned such that the outer ring 20 is in a rotating configuration.

Essentially, when the outer ring 20 is pushed downwardly, as seen in FIGS. 3A-D, bottom extensions 38 extending integrally from the bottom of the outer ring 20 engage into crescent shaped grooves 40 located in base plate 22. Thus, when the bottom extensions 38 are engaged into grooves 40 of the base plat 22, the outer ring is prevented from rotating. The inner ring 24 is also prevented from rotating because switch 12 located inside the "J" shaped groove 14 is connected to the side of the inner ring 24. As previously discussed, since the pole 30 is fixed to the inner ring 24, it cannot rotate.

In one embodiment, inner ring 24 is configured to rotate around an axis member 26 by way of a ball bearing 28, which is held in place via a snap ring 34, acting as an interface between the inner ring 24 and the axis member 26. In one embodiment, the axis member 26 is mechanically fastened to the base plate 22 by way of mechanical fasteners 29 such as flat head set screws. In one embodiment, the ball bearing 28 is fixedly attached to the inner ring 24 by way of a bearing connector 42.

When the outer ring is pivoted in an upward position, as seen in FIGS. 4A-D, the outer ring is raised above the base plate such that bottom extension 38 are not engaged into grooves 40 enabling the outer ring 20, inner ring 24, and in extension the pole 30 to rotate freely.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A mode changing mechanism for use with a pole, the mode changing mechanism comprising:

a base plate;

an inner ring, wherein the pole is mechanically fastened to the inner ring, the inner ring configured to rotate around an axis member fastened to the base plate;

an outer ring concentrically positioned outside the inner ring, the outer ring having a "J" shaped groove;

a switch positioned in the "J" shaped groove, the switch configured to alternate between a fixed configuration and a rotating configuration of the pole, wherein the rotating configuration enables the pole to rotate freely and the fixed configuration does not allow the pole to rotate.

2. The mode changing mechanism of claim 1, wherein the outer ring includes bottom extensions extending integrally from a bottom portion of the outer ring.

3. The mode changing mechanism of claim 2, wherein in the fixed configuration, the bottom extensions are configured to engage into grooves located in the base plate 22 to prevent rotation of the outer ring.

4. The mode changing mechanism of claim 3, wherein in the fixed configuration, the inner ring is prevented from rotating as the switch is positioned inside the "J" shaped groove connected to a side of the inner ring.

5. The mode changing mechanism of claim 3, wherein in the rotating configuration, the outer ring is raised above the base plate such that the bottom extension are not engaged into the grooves enabling the outer ring, inner ring, and the pole to rotate freely.

6. The mode changing mechanism of claim 1, wherein the base plate includes a rubber pad configured to rest on a floor surface.

* * * * *